United States Patent [19]

Enemark et al.

[11] 4,303,908

[45] Dec. 1, 1981

[54] ELECTRONIC SOUNDER

[75] Inventors: Robert B. Enemark, Duxbury; Aaron A. Galvin, Lexington; Stephen Marchetti, Norwell, all of Mass.

[73] Assignee: American District Telegraph Company, New York, N.Y.

[21] Appl. No.: 155,958

[22] Filed: Jun. 3, 1980

[51] Int. Cl.[3] ..... G08B 3/10

[52] U.S. Cl. ..... 340/384 E; 340/384 R

[58] Field of Search ..... 340/384 R, 384 E, 52 E; 331/162, 64; 307/237

[56] References Cited

U.S. PATENT DOCUMENTS

| | | | |
|---|---|---|---|
| 1,984,424 | 12/1934 | Osnos | 331/162 |
| 3,160,767 | 12/1964 | Tindall | 307/237 X |
| 3,259,841 | 7/1966 | Proctor | 307/237 X |
| 3,462,703 | 8/1969 | Seidel | 331/162 |
| 3,534,281 | 10/1970 | Hillhouse | 307/237 X |
| 3,628,127 | 12/1971 | Waldhavier | 307/237 X |
| 3,922,672 | 11/1975 | Birt | 340/384 E |
| 4,183,278 | 1/1980 | Rea | 340/384 E |

*Primary Examiner*—Harold I. Pitts

*Attorney, Agent, or Firm*—Weingarten, Schurgin & Gagnebin

[57] ABSTRACT

An electronic sounder employs a pair of piezoelectric oscillators tuned to different frequencies to provide loud raucous sound. The sounder is especially suited for providing audible indications of an alarm condition which is sensed by an associated alarm system.

9 Claims, 2 Drawing Figures

ELECTRONIC SOUNDER

FIELD OF THE INVENTION

This invention relates to sound generators and more particularly to an electronic sounder employing piezoelectric oscillators.

BACKGROUND OF THE INVENTION

In security installations there is often a need for a sound generator such as a horn or siren to provide an audible indication of an alarm condition. Horn sounders are usually of the electromechanical type which requires substantial power for energization. Electronic sound generators are also known for providing continuous or siren sounds but such devices also require relatively high power to provide a suitably intense sound level. It is known that the use of a sound generator employing two frequencies and providing a beat note in addition to the primary frequencies produces a sound which is more readily perceived by an individual because of the harsh or annoying nature of the sound. Many automobile horns operate in this manner. It is an object of this invention to provide an electronic sounder which operates with very low power to generate a loud raucous sound and which can be constructed in an extremely compact package at very low cost.

SUMMARY OF THE INVENTION

In brief, the electronic sounder comprises a pair of piezoelectric transducers each tuned to a different audible frequency to produce a predetermined beat note, and a low power solid state circuit for driving the transducers. The sounder is energized by a battery power source which includes current limiting circuit and a low current control input which permits sounder actuation by a low power switching device. The sounder is capable of generating loud, noticeable sound with only modest power consumption.

DESCRIPTION OF THE DRAWINGS

The invention will be more fully understood from the following detailed description taken in conjunction with the accompanying drawing in which.

DETAILED DESCRIPTION OF THE INVENTION

Figure 1:
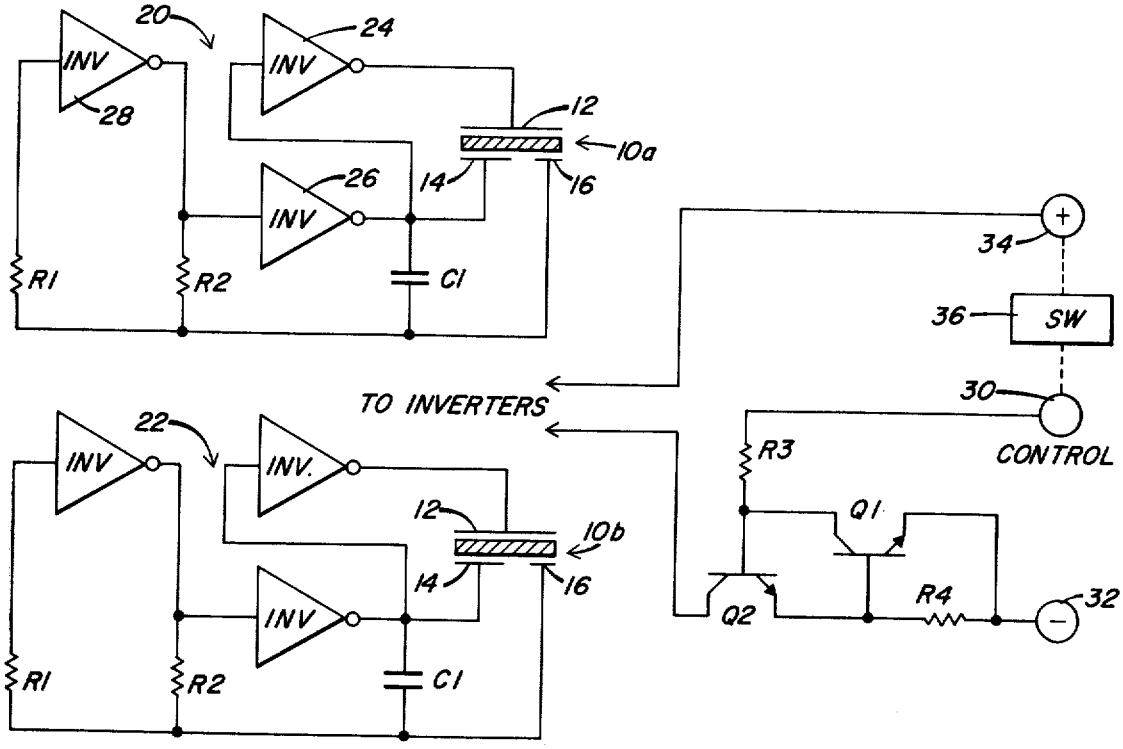
FIG. 1 is a schematic diagram of the electronic sounder.

Referring to FIG. 1, there is shown first and second piezoelectric transducers 10*a* and 10*b*, each connected in a driving circuit composed of inverting amplifiers. The transducers are three terminal piezoelectric devices such as Gulton disc benders, which are used in a feedback circuit to provide oscillation and tone generation. The feedback circuit is composed of six inverters which are provided in a CMOS integrated circuit chip such as a Motorola Model 4049UB Hex inverter/buffer. A push-pull driving voltage is applied to terminals 12 and 14 of each transducer. The third terminal 16 provides a feedback signal to enhance the oscillator drive. Each transducer is connected in identical circuit arrangement, and only one circuit will therefore be described.

The driving circuit 20 is composed of three inverters 24, 26, and 28 connected as shown. The resistors R1 and R2 provide biasing of the associated inverters 28 and 26.

A capacitor C1 serves to maintain the phase of the feedback signal from transducer terminal 16 for intended positive feedback. The circuit 22 for transducer 10*b* is similarly configured. These driving circuits are themselves known oscillator circuits.

Power from a battery source is provided to each of the inverters of the integrated circuit by means of a current limiting stage composed of transistors Q1 and Q2 and resistors R3 and R4 connected in circuit between a control terminal 30 and negative terminal 32. The sounder is energized by connecting the control terminal 30 to the positive input terminal 34, thereby applying power to the driving circuit and causing oscillation of the piezoelectric transducers. Alternatively, a current limiting circuit employing PNP transistors rather than the NPN transistors illustrated can be employed in the positive input side of the power circuit, with the control terminal 30 connected to the negative or ground terminal 32 to initiate the alarm. Connection of the control terminal to the power terminal for sounder operation is preferably accomplished by an electronic switch or relay 36 operated in response to an alarm signal.

The current limiting circuit prevents excess current flow to the CMOS chip in the event of failure of either of the transducers, as well as providing a low current control lead to permit actuation of the sounder by a low power switching device. The sounder is operative over a voltage range of about 8 to 14 volts DC, the nominal input being 12 volts at a current 40 milliamperes.

The current limiting circuit is composed of transistors Q1 and Q2 and resistors R3 and R4. The transistor Q2 is normally in saturated conduction, since sufficient base current is supplied by way of resistor R3 when the control terminal 30 is connected by switch 36 to the positive supply terminal 34. Transistor Q1 is normally nonconductive for sounder current below a predetermined value. When the current level exceeds this value, the voltage across resistor R4 exceeds the base-emitter voltage threshold for transistor Q1, causing this transistor to conduct and shunt the base of transistor Q2 to the negative supply lead. For a threshold voltage of 0.5 volt, and a resistance value for resistor R4 of 10 ohms, transistor Q1 will begin conducting when the sounder current exceeds about 50 milliamperes. The current through resistor R4 cannot increase appreciably and is thus limited to a tolerable limit irrespective of the load of the sounder on the power source. This current limiter prevents "hang-up" of integrated circuits or transistors in the inverters which can occur in the presence of transients or excessive driving current. For example, CMOS digital integrated circuits may have complementary output stages which alternately connect the output to one or the other of the power supply leads. If a transient causes the control signals to the complementary stage to overlap in time, both sections of the stage would momentarily conduct and would thereby short out the power source. Without current limiting, the integrated circuits can be damaged by overcurrent, or internal limiting can occur and cause hang-up of the feedback oscillator. The circuit would then have to be manually reset by interruption of applied power, which would be disadvantageous for reliable audible alarm signaling.

The transducers provide intended audio frequency sound outputs and are tuned or selected to produce a predetermined frequency difference which will achieve the desired sound character. Typically, the transducer frequencies can be 3,000±500 Hz. A frequency difference between the two frequencies can typically be about 500 Hz. Usually the transducer disc of one or both transducers is trimmed to produce the intended frequency difference. The sounder is capable of generating loud raucous sound with very low power consumption. For applied power of 12 volts at 40 milliamperes, an output sound level of about 100 dB can be produced at a distance of two feet from the sounder, and which is of broad, raucous character.

Figure 2:
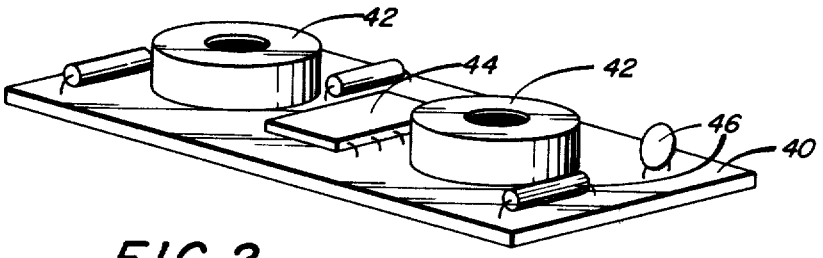
FIG. 2 is a pictorial view of the electronic sounder as assembled on a circuit board.

The sounder is typically packaged on a small printed circuit board such as illustrated in FIG. 2. The circuit board 40 includes the two piezoelectric devices, each contained within a respective cylindrical housing 42, integrated circuit 44, and associated discrete components 46. This assembly can be enclosed in any convenient housing to provide a separate sounder unit, or the assembly can be contained within other apparatus such as an intrusion detector to provide the audible alarm indication. The sounder lends itself to disguised mounting, since the sound produced is of such a nature as to be rather unfocused as perceived by a listener, and thus the source of sound is often not readily determined by a listener. As an example, the sounder can be hidden behind a wall power outlet plate to hide its presence and minimize easy access to the sounder unit.

The invention is not to be limited except as indicated in the appended claims.

What is claimed is:

1. An electronic sounder for producing a raucous loud sound with minimum supplied power comprising:

a first piezoelectric transducer for producing audible sounds having a first frequency in the audible frequency range;

a second piezoelectric transducer for producing audible sounds having a second frequency in the audible frequency range different than said first frequency by an amount to provide a predetermined audible beat note difference between the first and second frequencies;

a low power solid state circuit coupled to said piezoelectric transducers and operative to energize the transducers;

a power source for providing power to said solid state circuit, including a battery and a current limiting circuit, said current limiting circuit including means for providing power to said solid state circuit only when said current limiting circuit is connected to said battery; and means for selectively connecting the battery to the current limiting circuit to energize the sounder.

2. The electronic sounder of claim 1 wherein the current limiting circuit includes a control terminal;

and wherein said selective connecting means is operative to connect the control terminal to one of the terminals of the battery.

3. The electronic sounder of claim 1 wherein said first and second piezoelectric transducers are three terminal transducers having two terminals for application of a driving voltage and a third terminal for providing a feedback signal; and wherein said solid state circuit includes a feedback oscillator circuit for providing a driving voltage to the first and second terminals of each of the transducers and for receiving a feedback signal from the third terminal of each of the transducers.

4. The electronic sounder of claim 3 wherein the solid state circuit is a CMOS integrated circuit.

5. The electronic sounder of claim 1 wherein the current limiting circuit of the power source includes a solid state circuit connected between the control terminal and the other of the battery terminals operative to permit actuation of the sounder by a low power switching means and to prevent excess current flow to the solid state circuit.

6. The electronic sounder of claim 5 wherein the solid state circuit is a CMOS integrated circuit Hex inverter.

7. The electronic sounder of claim 2 wherein the current limiting circuit of the power source includes:

first transistor means which is in conduction when the control terminal is connected to the battery; and second transistor means which is conductive for applied current above a predetermined level and being operative to shunt the first transistor means to limit the current to approximately the predetermined level.

8. The electronic sounder of claim 1 wherein the frequencies of the first and second piezoelectric transducers are about 3,000±Hz.

9. An electronic sounder for producing a raucous loud sound with minimum supplied power comprising:

a first piezoelectric transducer for producing audible sounds having a first frequency in the audible frequency range;

a second piezoelectric transducer for producing audible sounds having a second frequency in the audible frequency range different than said first frequency by an amount to provide a predetermined audible beat note difference between the first and second frequencies; and, means for energizing said piezoelectric transducers.

* * * * *